US006361091B1

(12) United States Patent
Weschler

(10) Patent No.: US 6,361,091 B1
(45) Date of Patent: Mar. 26, 2002

(54) APPARATUS AND METHODS FOR OPENING A VEHICLE HOOD

(76) Inventor: Bradley R. Weschler, 8 Longwood Dr., South Huntington, NY (US) 11746

( * ) Notice: Subject to any disclaimer, the term of this patent is extended or adjusted under 35 U.S.C. 154(b) by 0 days.

(21) Appl. No.: 09/584,284

(22) Filed: May 31, 2000

(51) Int. Cl.[7] ..... E05B 63/20
(52) U.S. Cl. ..... 292/336.3; 292/225; 292/DIG. 14
(58) Field of Search ..... 292/336.3, 225, 292/133, DIG. 14; 74/502.4, 502.6

(56) References Cited

U.S. PATENT DOCUMENTS

| | | | | |
|---|---|---|---|---|
| 2,246,791 A | | 6/1941 | Dall | |
| 2,809,064 A | | 10/1957 | Dlugatch | |
| 3,572,790 A | * | 3/1971 | Kapanka | 292/125 |
| 3,788,168 A | | 1/1974 | Steinmann, Jr. | |
| 4,099,593 A | | 7/1978 | Schultz | |
| 4,382,482 A | * | 5/1983 | Brandl et al. | 180/69 R |
| 4,796,929 A | * | 1/1989 | Gergoe | 292/28 |
| 4,991,884 A | | 2/1991 | Cairns | |
| 5,046,768 A | * | 9/1991 | Myslicki | 292/68 |
| 5,306,053 A | | 4/1994 | Gurusami et al. | |
| 5,456,142 A | | 10/1995 | Mosher et al. | |
| 5,853,060 A | | 12/1998 | Chao et al. | |
| 6,050,619 A | * | 4/2000 | Arabia, Jr. et al. | 292/216 |
| 6,092,845 A | * | 7/2000 | Koenig | 292/225 |

* cited by examiner

*Primary Examiner*—Matthew C. Graham
*Assistant Examiner*—Devon Kramer
(74) *Attorney, Agent, or Firm*—Galgano & Burke

(57) ABSTRACT

Devices and methods of releasing engine compartment hoods, designed to be used in conjunction with vehicles equipped with passenger compartment hood releases allow a hood to be released from outside the vehicle. The disclosed devices are positioned between an existing lock assembly and the protective sheath of the existing release cable.

24 Claims, 6 Drawing Sheets

APPARATUS AND METHODS FOR OPENING A VEHICLE HOOD

The present invention relates to apparatus and methods for opening the hood of a vehicle and, are particularly useful for auto body repair persons who must typically open and close a vehicle hood many times during the course of certain repairs.

BACKGROUND

Those skilled in the art of auto body repair will appreciate that a vehicle hood, i.e. the movable cover which provides access to an engine compartment must typically be opened and closed many times in order to effect proper fit and alignment of the hood and its adjacent panels. Each time the hood is opened and closed, it is necessary for the auto body repair technician to walk around to the interior of the car in order to release the hood. Alternatively, a second technician must be utilized to sit within the car and open the hood release each time the hood is opened and closed. In either case, repair of a hood and its adjacent panels is made more tedious and time-consuming by the need for tripping the hood release while effecting the vehicle repair.

It is therefore desirable to provide a hood release for a conventional vehicle which can be readily used with many vehicles, which is relatively inexpensive, and which allows a single auto body repair technician to open the hood of a vehicle from the front of the vehicle and without requiring a trip to the interior passenger compartment or an assistant.

DETAILED DESCRIPTION

The various embodiments of the present invention comprise methods and devices for releasing the lock assembly of a vehicle hood from a location proximate the front of the vehicle. Those skilled in the art of auto body repair will appreciate that a vehicle hood release typically comprises a hood lock assembly, a release cable having a proximal end connected to a handle located within the passenger compartment of the vehicle and a terminal end operatively connected to a hood lock assembly, a cable cover comprising a sheath and one or more terminal end attachments disposed over substantially the entire length of the cable leaving a terminal portion of the cable exposed. A terminal end of the sheath or protective attachment members of the cable cover are spaced from the terminal end of the actual cable. Typically, a support attached to the vehicle abuts the terminal end of the cable cover. In order to release the hood lock assembly, a person must typically pull the handle located within the passenger compartment of the vehicle causing the cable to move relative to the terminal end of the cable cover and thereby tripping the hood release mechanism. This typical hood release does not rely upon movement of the cable cover, however, sufficient movement of the cable cover can be used to release the hood lock since specifications allow only a minimum amount of play between the cable cover and the cable. Therefore, if the cable cover is moved in the same direction that the cable is usually drawn when releasing the hood, the movement of the protective cover will cause the cable to move thereby tripping the hood release mechanism. The various embodiments of the present invention operate on the principle that movement of the cable sheath or other portions of the cable cover will effect movement of the terminal end of the cable to release the vehicle hood.

Figure 1:
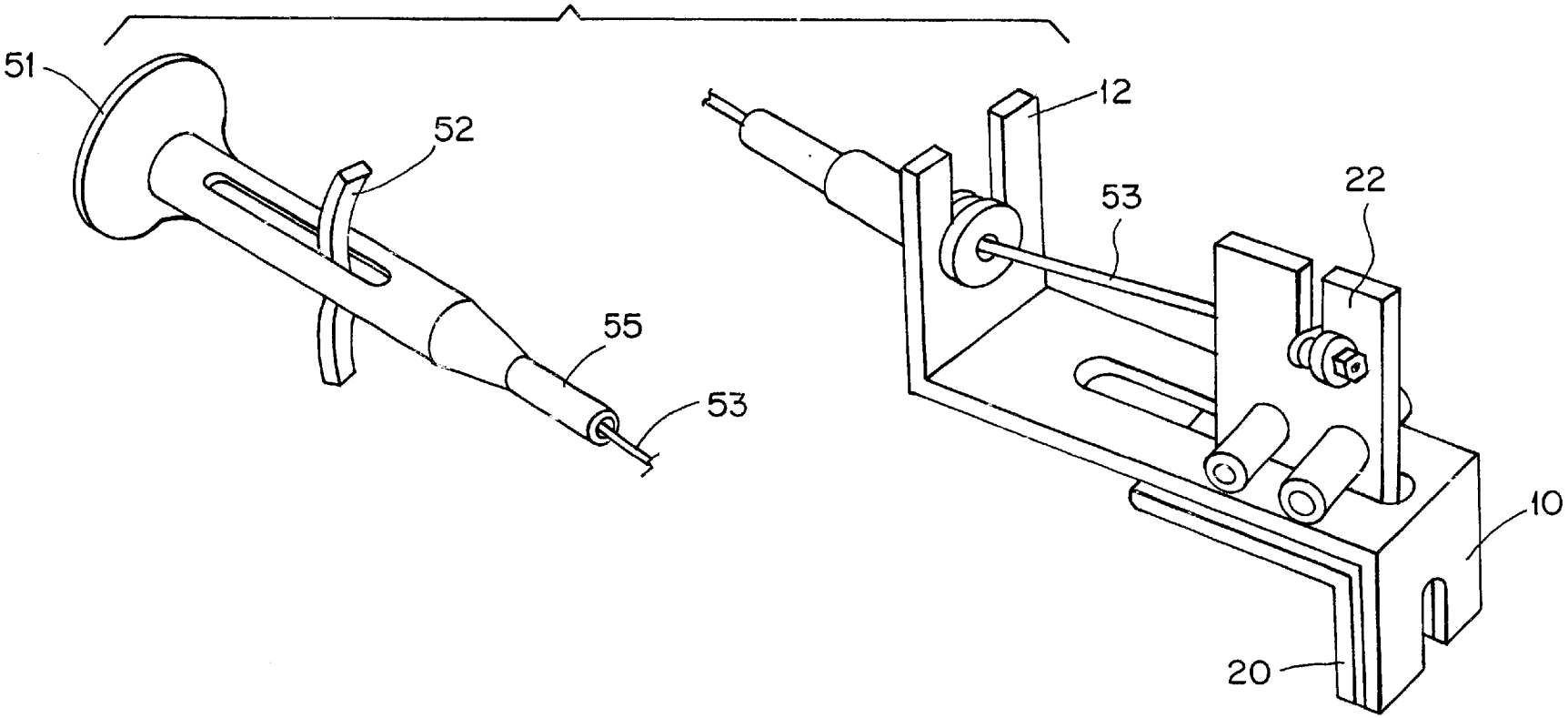
FIG. 1 is an exploded view of a supplemental vehicle hood release of one embodiment of the present invention.
Figure 2:
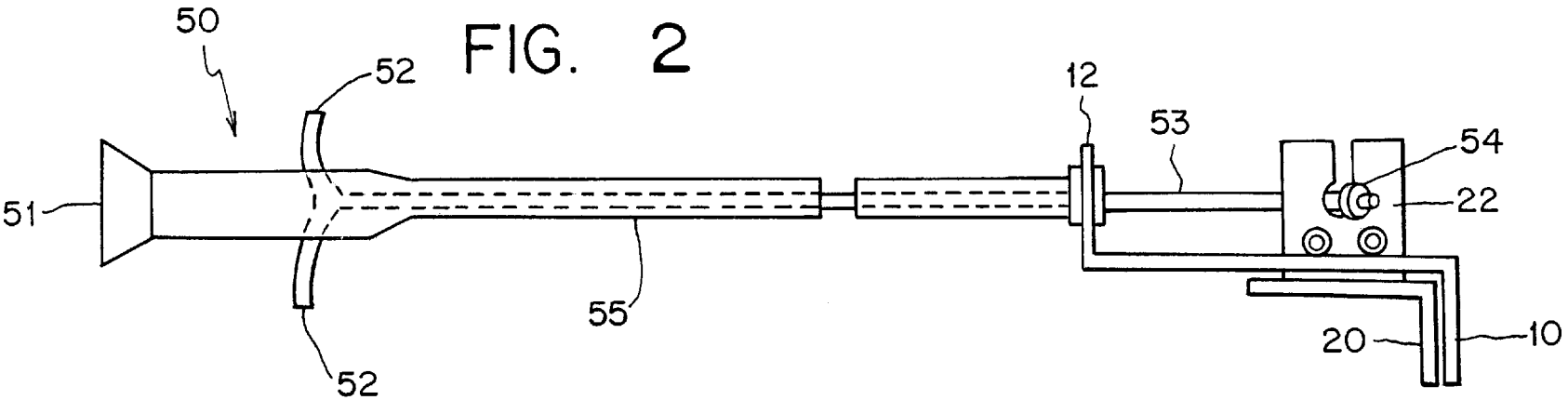
FIG. 2 is a side perspective view of the embodiment shown in FIG. 1 in a non-actuated position.
Figure 3:
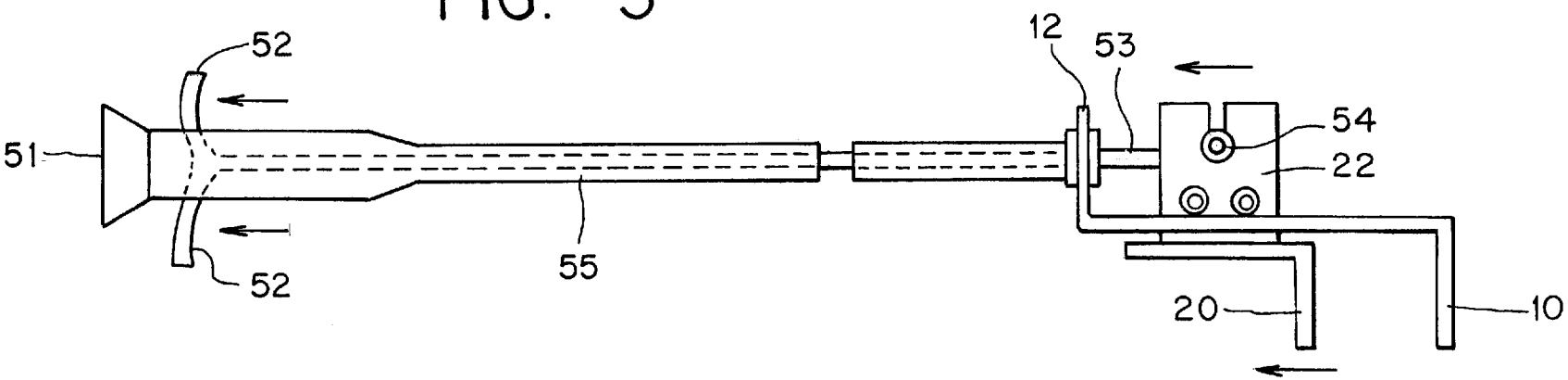
FIG. 3 is a side view of the embodiment of the present invention shown in FIG. 1 in an actuated position.

One embodiment of the present invention is illustrated FIGS. 1 to 3 wherein a first member 10 and a second member 20 are selectively movable relative to each other by a remote, manually operated actuator 50. The manually operated actuator comprises a base 51, finger grips 52, a cable 53 having a terminal end 54 and a cable cover 55. The proximal end of the cable 53 is attached to the finger grips 52 while the proximal end of the cable cover or sheath 55 is connected to the base 51. In this illustrated embodiment, the base 51 is integrally molded with the cable cover 55, however, from the present description, one skilled in the art will appreciate that these pieces can be manufactured separately. The terminal end 54 of the cable 53 is connected to a portion of second member 20 while the terminal end of the cable cover 55 is connected to a flange 12 on the first member 10.

Figure 4A:
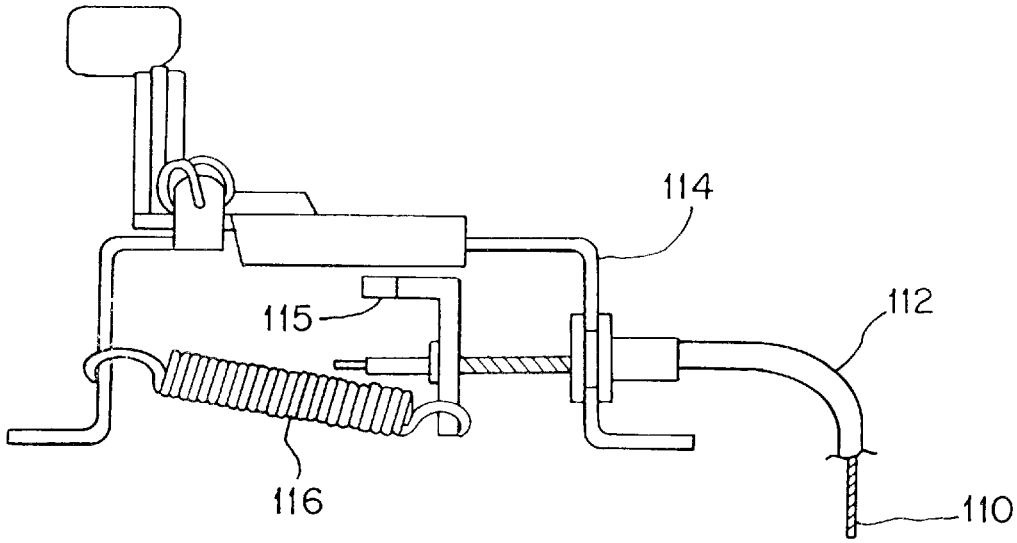
FIGS. 4A–4D illustrate portions of a conventional vehicle hood lock mechanism and the insertion and use of the supplemental vehicle hood release shown in FIG. 2.

FIG. 4A illustrates portions of a vehicle lock assembly wherein a conventional cable 110 and a sheath 112 are connected to a bracket 114. When a person desires to open this hood in a conventional manner, the hood release in a vehicle (not shown) is pulled causing cable 110 to move to the right in this illustrated embodiment thereby moving hood release member 115 in a manner which trips the hood release. When the person releases the hood release lever in the passenger compartment, spring 116 draws the hood release mechanism back toward the left in the illustration. FIG. 4A therefore illustrates portions of a conventional vehicle hood release mechanism.

Figure 4B:
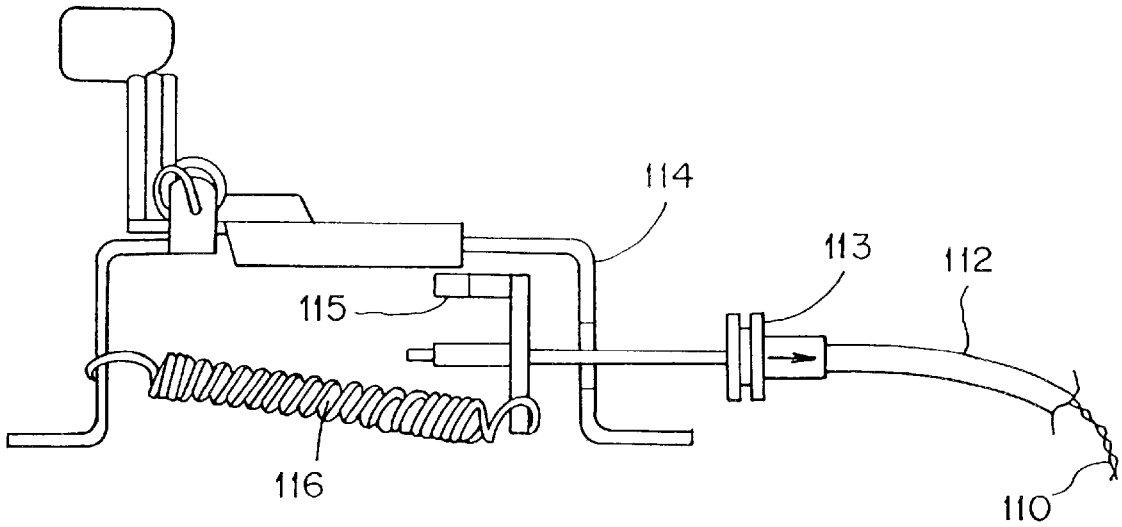
FIG. 4B (PRIOR ART)
Figure 4C:
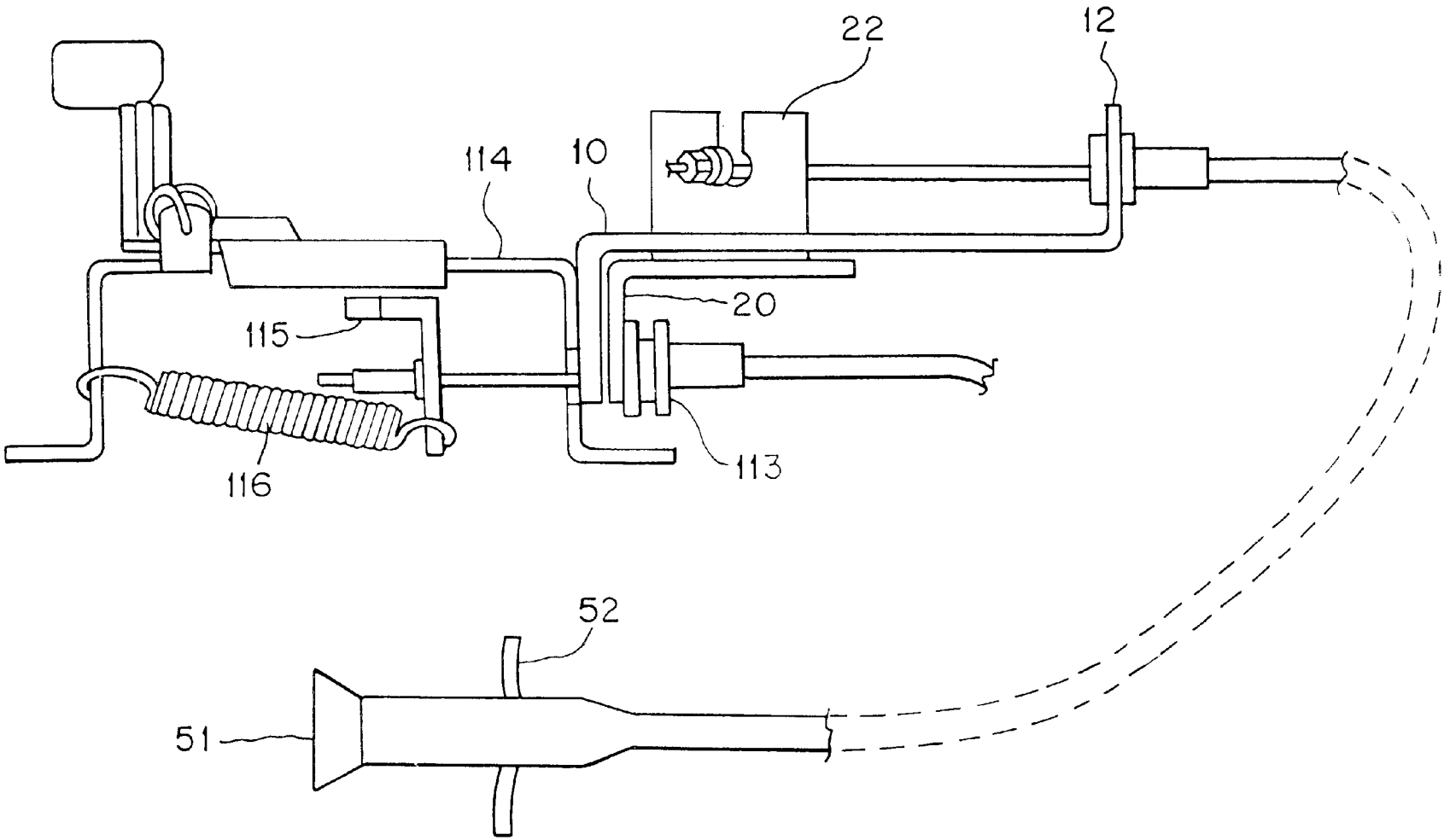
Figure 4D:
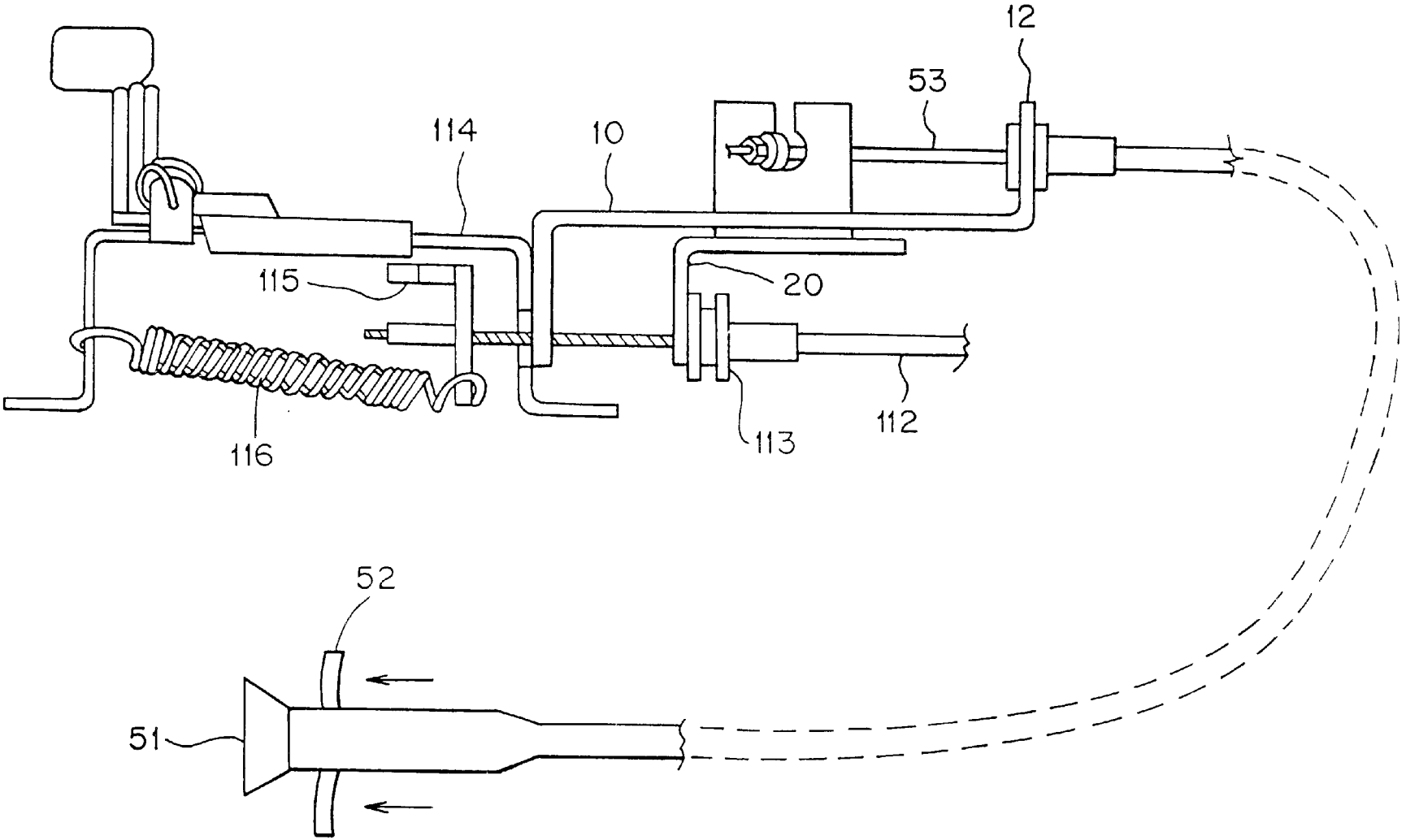

In order to install the supplemental hood release mechanism of the present invention, the sheath 112 and terminal connector 113 are disconnected from support bracket 114 as illustrated in FIG. 4B and relatively movable elements 10 and 20 are inserted over the portion of the cable between support bracket 114 and the terminal connector 113 located on the end of sheath 112. The supplemental hood release of this embodiment of the present invention is now in position for actuation. As illustrated in FIGS. 4C and 4D, movement of the finger grips 52 relative to base 51 on the supplemental hood release will cause sheath 112 to be moved to the right in this illustration. After the minimal amount of play existing between cable 110 and sheath 112 has been eliminated, movement of the sheath 112 to the right will cause cable 110 to also move to the right. Those skilled in the art will appreciate that sufficient movement of cable 110 to the right will cause sufficient movement of hood lock release member 115 thereby tripping the hood release. The amount of movement required to trip a hood release may vary between different vehicles and therefore the movement provided by a supplemental hood release of the present invention can also be used to provide different amounts of movement. However, a typical supplemental hood release may move a conventional hood release cable sheath about 1/16 inch to about 3 inches, more preferably about 1/8 inch to about 3/4 inch, or most preferably about 1/4 inch to about 1/2 inch.

Figure 5:
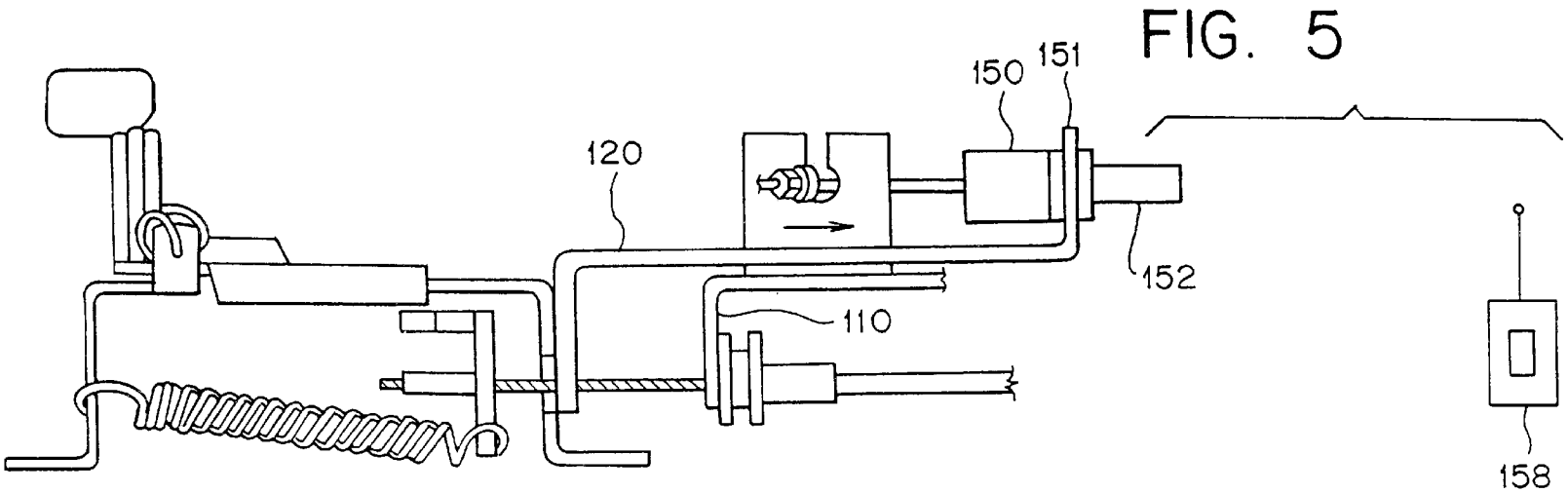
FIG. 5 illustrates a further embodiment of the present invention.

While the preferred illustrated embodiment shown in FIGS. 1 to 3 relies upon a manual actuator for causing movement between the first member 10 and the second member 20, alternative embodiments of the present invention rely upon other mechanisms for causing this relative movement. FIG. 5 illustrates an electronic actuator comprising a solenoid 150, a battery pack 151, and a radio frequency receiver 152. When a signal is generated by remotely operated radio transmitter 158, a signal is received by the actuator 150 causing the solenoid 150 to move second element 120 away from first element 110 with the same effect as discussed above with reference to the embodiment of FIGS. 1 to 3.

Figure 6:
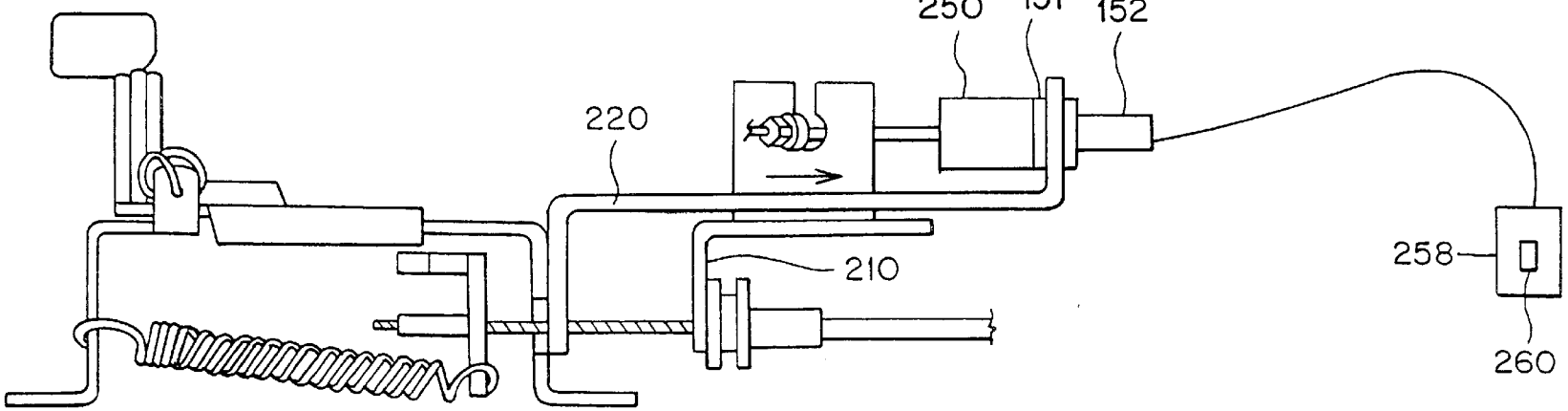
FIG. 6 illustrates a still further embodiment of the present invention.

According to a still further embodiment of the present invention, illustrated in FIG. 6, a signal transmitter 258 is hard wired to an electronic actuator comprising a solenoid 250. In this embodiment, the push of button 260 on remote control 258 causes the solenoid 250 to move second element 220 relative to first element 210.

Other embodiments of the present invention comprise methods for releasing an engine compartment hood on a vehicle which comprises as standard equipment a hood lock assembly, a release cable comprising a proximal end located proximate a passenger compartment and a terminal end operatively connected to the hood lock assembly, a cable comprising a terminal end spaced from the cable terminal end, and a support abutting the terminal end of the cover. The method comprises the steps of positioning a first member and second member which is movably positioned relative to the first member between the terminal end of the cable cover and the support, and causing the second member to move relative to the first member sufficiently to release the vehicle hood.

What is claimed is:

1. A supplemental vehicle hood release for use on a vehicle conventional hood lock assembly comprising a release cable comprising a proximal end located proximate a passenger compartment and a terminal end operatively connected to said hood lock assembly, a cable cover comprising a terminal end spaced from said cable terminal end, and a support abutting said terminal end of said cover, said supplemental vehicle hood release comprising:

a first member;

a second member movably positioned relative to said first member;

means for selectively moving said first member relative to said second member, wherein when said first member and said second member are positioned between said cover terminal end and said support, sufficient movement of said cover releases the vehicle hood.

2. A supplemental vehicle hood release according to claim 1 wherein said first member comprises a bracket.

3. A supplemental vehicle hood release according to claim 2 wherein said second member comprises a bracket.

4. A supplemental vehicle hood release according to claim 1 wherein said second member comprises a bracket.

5. A supplemental vehicle hood release according to claim 1 wherein said moving means comprises:

a cable comprising a proximal end and a distal, terminal end operatively connected to said second member, a cable cover comprising a proximal end and a distal, terminal end operatively connected to said first member, and an actuator connected to said proximal end of said cable and said proximal end of said cable cover for moving said cable relative to said cover.

6. A supplemental vehicle hood release according to claim 5 wherein said actuator is manually operated.

7. A supplemental vehicle hood release according to claim 5 wherein said actuator is electronically operated.

8. A supplemental vehicle hood release according to claim 1 wherein said moving means is manually operated.

9. A supplemental vehicle hood release according to claim 1 wherein said moving means is electronically operated.

10. A supplemental vehicle hood release according to claim 9 comprising a signal transmitter and a signal receiver.

11. A supplemental vehicle hood release according to claim 10 wherein said signal is a radio frequency signal.

12. A supplemental vehicle hood release according to claim 9 wherein said moving means comprises a solenoid.

13. A method of releasing a vehicle hood for use on a vehicle conventional hood lock assembly comprising a release cable comprising a proximal end located proximate a passenger compartment and a terminal end operatively connected to the hood lock assembly, a cable, comprising a terminal end spaced from the cable terminal end, and a support abutting the terminal end of the cover, the method comprising the steps of:

positioning a first member and second member which is movably positioned relative to the first member between the terminal end of said cable cover and said support, and causing said first member to move relative to the second member sufficiently to release the vehicle hood.

14. A method according to claim 13 wherein said step of positioning a first member comprises positioning a bracket.

15. A method according to claim 14 wherein said second member comprises a bracket.

16. A method according to claim 13 wherein said step of positioning a second member comprises positioning a bracket.

17. A method according to claim 13 wherein said step of moving said first member relative to said second member comprises providing a cable comprising a proximal end and a distal, terminal end operatively connected to said second member, a cable cover comprising a proximal end and a distal, terminal end operatively connected to said first member, and an actuator connected to said proximal end of said cable and said proximal end of said cable cover for moving said cable relative to said cover.

18. A method according to claim 17 wherein said step of positioning an actuator comprises providing an actuator which is manually operated.

19. A method according to claim 17 wherein said step of positioning an actuator comprises providing an actuator which is electronically operated.

20. A method according to claim 13 wherein said movement causing step is performed manually.

21. A method according to claim 13 wherein said movement causing step is performed electronically.

22. A method according to claim 21 wherein said step of causing movement comprises generating an electromagnetic signal.

23. A method according to claim 22 wherein said step of causing movement comprises generating an electromagnetic radio frequency.

24. A method according to claim 23 wherein said step of causing movement comprises actuating a solenoid.

* * * * *